United States Patent [19]

Kruger et al.

[11] 4,020,575

[45] May 3, 1977

[54] IDENTIFICATION BADGE

[75] Inventors: James Brompton Kruger, Oxford; Karl Frederick Sonntag, Middlebury, both of Conn.

[73] Assignee: Scovill Manufacturing Company, Waterbury, Conn.

[22] Filed: Feb. 4, 1976

[21] Appl. No.: 653,101

[52] U.S. Cl. ..... 40/1.5; 40/25 R

[51] Int. Cl.[2] ..... A44C 3/00

[58] Field of Search ..... 40/1.5, 1.6, 20, 25, 40/24, 26, 144

[56] References Cited

UNITED STATES PATENTS

| | | | |
|---|---|---|---|
| 1,999,786 | 4/1935 | Rosenblum | 40/1.5 |
| 2,077,285 | 4/1937 | Thackeray | 40/20 R |
| 2,213,449 | 9/1940 | Mungen | 40/1.5 X |
| 2,609,629 | 9/1952 | Hubbard | 40/1.5 |
| 2,618,086 | 11/1952 | Komorous | 40/1.5 |
| 3,559,318 | 2/1971 | Sitzberger | 40/1.5 |
| 3,810,321 | 5/1974 | Kiba | 40/1.5 |

*Primary Examiner*—Louis G. Mancene
*Assistant Examiner*—Wenceslao J. Contreras
*Attorney, Agent, or Firm*—Dallett Hoopes

[57] ABSTRACT

Identification badge has clamping panel of flexible plastic formed with a tongue interconnecting a pair of spaced apertures by which base run of safety-pin-like fastener is held. Panel is ultrasonically sealed to the rear flap of badge envelope to immobilize the fastener with respect thereto.

2 Claims, 4 Drawing Figures

IDENTIFICATION BADGE

BACKGROUND OF THE INVENTION

1. Field of the Invention

This invention relates to identification badges of the transparent type including safety-pin-like fastener means adapted to be pinned onto the clothing of the wearer.

2. Description of the Prior Art

In the prior art, there have been identification badges in which the badge envelope portion has comprised a single sheet of transparent acetate or the like flexible plastic having a front or display panel and doubled-back flaps running along opposite edges of the display panel. Openings through one of the flaps have passed the base run of a safety-pin-like fastener to hold the fastener to the envelope. Such devices, however, have had the drawback that they have required hand assembly and, once assembled, the base run of the fastener has been disposed between the display panel and the flaps so as to interfere with the insertion of the identification card normally used with such badges.

In other forms, the prior art has involved the riveting of a safety-pin-like device to the rear of such a badge body. An example is shown in the U.S. Pat. No. 3,810,321, which issued May 14, 1974 to Kiba.

SUMMARY OF THE INVENTION

In the present invention, an identification badge comprises a special clamping panel, preferably of acetate or the like, which includes a pair of apertures through which the base run of a safety-pin-like fastener is threaded, the clamping panel having a V-shaped tongue connecting the apertures so that the fastener can be readily engaged by the clamping panel. The panel is then secured, preferably by ultrasonic welding, to one of the flaps in the back of the identification badge envelope. This arrangement permits mechanical assembly and secure immobility of the fastener with respect to the envelope. Moreover, since no portion of the fastener is disposed between flap and display panel of the envelope, there is no interference of the fastener as the identification card is inserted into the envelope.

DESCRIPTION OF THE DRAWINGS

Other features of the invention will be apparent from a reading of the following disclosure and references to the accompanying drawings, all of which disclose a non-limiting preferred embodiment of the invention. In the drawings.

DESCRIPTION OF THE PREFERRED EMBODIMENT

Figure 1:
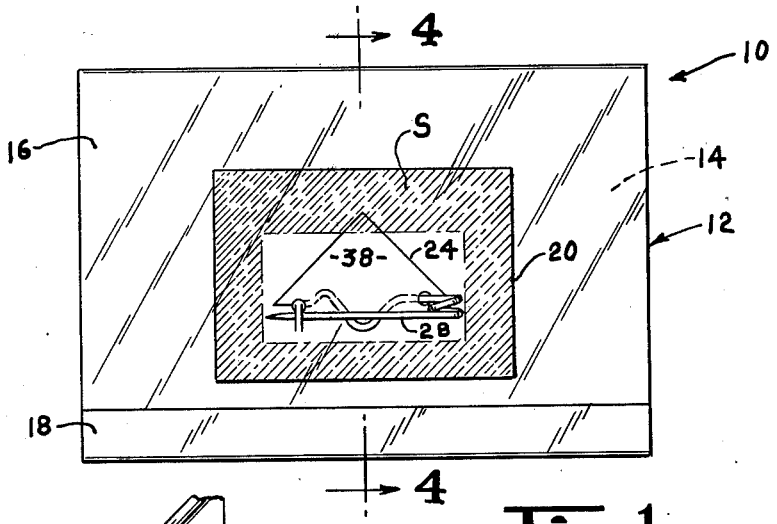
FIG. 1 is a rear view of an identification badge embodying the invention.

Referring more specifically to the drawings, a badge embodying the invention is generally designated 10 in FIG. 1. It comprises an envelope 12 having a front panel 14 to which is attached a major flap 16 and a minor flap 18, as shown. In assembly with the identification card in the envelope, the margin of the major flap is inserted under the minor flap 18. This construction is similar to the cover of an ordinary book of safety matches and the identification card is held in the closed envelope much the way the matches are enclosed by the cover.

In practice, the single sheet comprising the envelope is of acetate or similar transparent stiffly flexible plastic.

Figure 2:
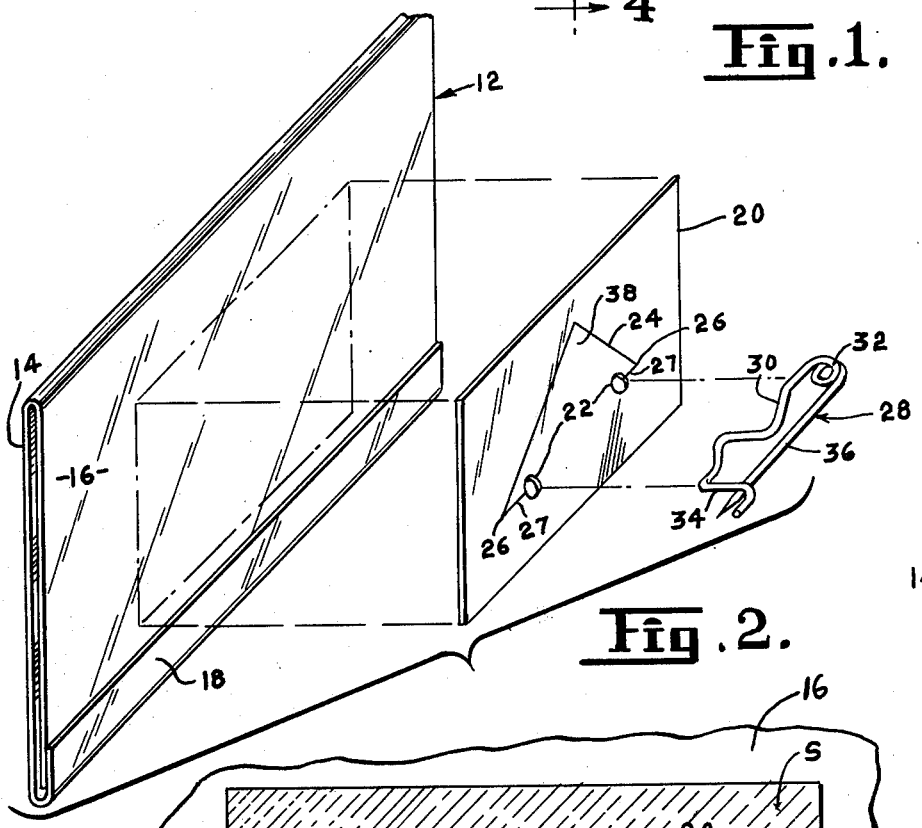
FIG. 2 is an exploded view in perspective of the rear of such a badge.
Figure 3:
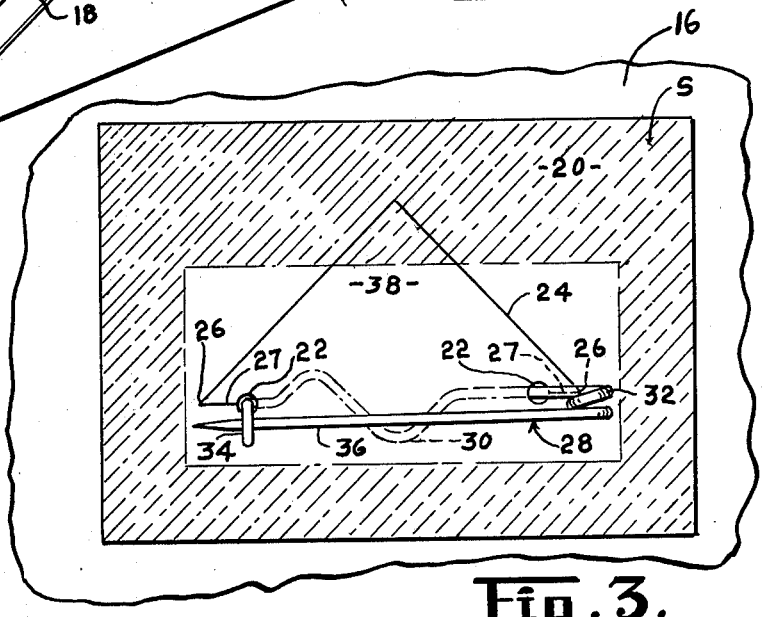
FIG. 3 is an enlarged view especially showing the clamping panel of a badge embodying the invention.
Figure 4:
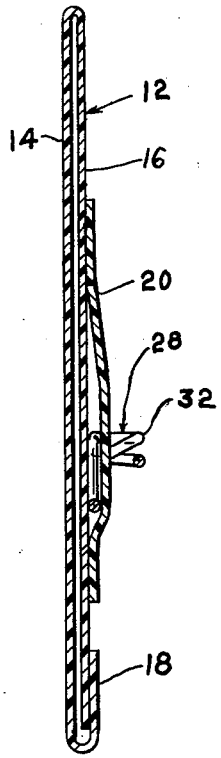
FIG. 4 is a sectional view taken on the line 4—4 of FIG. 1.

The embodiment also comprises a clamping panel 20, generally smaller than the flap 16, and adapted to be secured flat against such a flap. Preferably, the panel is also of acetate or other flexible plastic. As shown, the clamping panel is formed with a pair of spaced apertures 22 (FIG. 2). The clamping panel 20 is slit in a V-shaped slit 24 with the terminals of the rays of the "V" disposed outward of the apertures 22 respectively, as at 26. These terminals 26 are connected to the adjacent apertures 22 respectively by secondary slits 27. The embodiment further comprises a safety-pin-like fastener 28 of wire comprising a base run 30 having a spring hinge 32 at one end and a catch 34 at the opposite end. From the hinge 32, a pin run 36 extends outwardly so as to engage the catch 34, as shown. In assembly, which may be accomplished by apparatus rather than by hand, the distal end of the tongue 38 defined by the V-shaped slit 24 is lifted up from the clamping panel 20 and is inserted between the base run 30 and the pin run 36 of the fastener so that the base run winds up threaded into and out of the apertures 22 respectively in final assembly.

Thereafter, the clamping panel 20 is secured as by ultrasonic welding or the like, directly against the major flap 16. This is as shown in the hatched area S in FIG. 1. It is important that the sealed area include at least some of the tongue 38 so that the tongue may not thereafter lift up and permit the escape of the fastener 28, as will be understood.

It will be apparent that the trapping of the base run of the fastener 28 between the panel 20 and the flap 16 is readily accomplished by the sealing process. The capture of the base run through the apertures 22 immobilizes the pin with the fastener 28. Once the pin run 36 is applied to the clothing, the envelope 12 is not readily given to pivoting about. This keeps the envelope and material therein well oriented.

It will additionally be noted that the base run 30 for at least a portion thereof is bent in the form of a sine wave defining thereby a plane which is parallel to the pin run 36. In final assembly, this further immobilizes the fastener so that the pin run does not fold down against the back of the badge which would make it awkward to attach to clothing.

Moreover, the absence of the base run 30 between the flap 16 and the display panel 14 eliminates the interference of that element with the insertion of identification card material into the envelope.

It will be seen that I have devised a structure which has many benefits. It should be noted that the structure is readily assembled by automated machinery.

Having thus described an embodiment of the invention, it should be understood that many variations are possible, all falling within the scope of the following claim language and equivalents thereof.

I claim:

1. An identification badge comprising an envelope of transparent stiffly flexible sheet material including a front or display panel, two opposite edges of which are doubled back to present a pair of oppositely directly flaps, one of which is shorter than the other, the margin of the larger fitting releasably under the shorter; a wire safety-pin-like fastener comprising a base run having a spring hinge at one end and a catch at the other end, and a pin run extending out from the hinge; and a clamping panel also of transparent stiffly flexible sheet material and having a pair of spaced apertures, the clamping panel being formed with a V-shaped slit to define a tongue, the terminals of the rays of the V being outward from the apertures respectively and said terminals being connected respectively to the adjacent apertures by secondary slits, the said base run extending through the apertures so that the intermediate portion of the base run is on the envelope side of the clamping panel and the remainder of the fastener is on the opposite side of the clamping panel, the panel being sealed to the larger flap of the envelope in areas completely surrounding the base run, the areas including a portion of the tongue whereby the hold of the clamping panel on the fastener immobilizes the fastener with respect to the envelope, and no part of the fastener is disposed between the front part of the panel and the flaps.

2. An identification badge as claimed in claim 1 wherein the portion of the base run is bent generally in the shape of a sine wave to define a plane generally parallel to the pin run.

* * * * *